US005085393A

United States Patent [19]

Ryan

[11] Patent Number: 5,085,393

[45] Date of Patent: Feb. 4, 1992

[54] HANGER ASSEMBLY METHOD AND APPARATUS

[76] Inventor: Patrick V. Ryan, 6615 Abraham La., Albany, Oreg. 97321

[21] Appl. No.: 557,545

[22] Filed: Jul. 24, 1990

[51] Int. Cl.[5] ..... E04B 5/52

[52] U.S. Cl. ..... 248/343; 248/57; 248/906

[58] Field of Search ..... 248/343, 57, 906, 343, 248/342, 344; 52/28; 220/3.2

[56] References Cited

U.S. PATENT DOCUMENTS

| | | | |
|---|---|---|---|
| 1,464,620 | 8/1923 | Tefft | 248/906 X |
| 1,579,136 | 3/1926 | Paxson | 248/343 |
| 1,789,124 | 1/1931 | Wever | 248/906 X |
| 1,856,356 | 5/1932 | Owen | 248/906 X |
| 2,345,053 | 3/1944 | Judd et al. | 411/523 |
| 2,364,880 | 12/1944 | Tinnerman | 411/527 |
| 2,717,622 | 9/1955 | Flora | 411/112 |
| 2,861,121 | 11/1958 | Wolar | 248/343 |
| 2,925,236 | 12/1957 | Cook et al. | 248/276 |
| 2,964,229 | 12/1960 | Galloway | 248/57 |
| 3,463,432 | 8/1969 | Ptak | 411/174 X |
| 4,041,657 | 8/1977 | Schuplin | 248/343 X |
| 4,096,964 | 6/1978 | Glick | 52/221 |
| 4,149,693 | 4/1979 | LoNigro | 248/906 X |
| 4,304,958 | 12/1981 | Neff et al. | 174/65 R |
| 4,391,428 | 7/1983 | Grimes | 248/906 |
| 4,463,923 | 8/1984 | Reiker | 248/546 |
| 4,494,296 | 1/1985 | Grimes | 29/432 |
| 4,684,092 | 8/1987 | Reiker | 248/200.1 |

FOREIGN PATENT DOCUMENTS

| | | | |
|---|---|---|---|
| 0244677 | 12/1925 | United Kingdom | 248/57 |

OTHER PUBLICATIONS

Erico Products Catalog, "Caddy Wedge Hangers", Cleveland, Ohio, 1973.

*Primary Examiner*—Reinaldo P. Machado
*Attorney, Agent, or Firm*—Marger, Johnson, McCollom & Stolowitz

[57] ABSTRACT

A hanger assembly comprising a pair of elongate rails is supported by the top surface of a pair of boards in a truss which supports a ceiling. The hanger assembly includes a pair of rails which define a vertical slot therebetween. A clip mounted on the rail assembly is slidable along the length thereof and supports a vertical threaded rod. A junction box is mounted on the lower end of the rod with the lowermost portion of the rod extending below the level of the ceiling. A light fixture is mounted on the lowermost portion of the rod. In another embodiment, a cup suspended on the lowermost portion of the rod supports a screen which covers a hole in the ceiling. Plaster is applied over the screen and cup to patch the ceiling.

22 Claims, 2 Drawing Sheets

HANGER ASSEMBLY METHOD AND APPARATUS

BACKGROUND OF THE INVENTION

1. Field of the Invention

The present invention relates to hanger assemblies and more particularly to hanger assemblies which are used for mounting a fixture on a ceiling.

2. Description of the Related Art

Prior art fixture hangers are known. One such prior art hanger is shown in U.S. Pat. No. 4,463,923 issued to Reiker for a hanger assembly. The Reiker hanger assembly includes an extensible rod which is extended into biting contact with opposed surfaces of adjacent ceiling joists. A box mountable on a portion of the rod is positioned over a hole in the ceiling for receiving electrical wiring from above and for supporting a light fixture or the like from below.

The Reiker hanger assembly suffers from several disadvantages. First, lateral engagement with ceiling joists does not anchor the hanger assembly firmly against downward forces. In other words, sufficient downward force can cause the opposing ends of the hanger assembly, which are each urged into the sides of opposing joists, to slip downwardly.

In the Reiker device, the extensible rod is provided by an assembly which includes a first rod which is threadably received in an axial bore formed in a second rod. The assembly is extended by screwing and unscrewing the first threaded rod. After the assembly is secured between a pair of opposing joists, the junction box cannot be positioned over the exposed threaded portion of the first rod. The box thus may not be laterally positioned anywhere between the opposing joists.

SUMMARY OF THE INVENTION

The hanger assembly of the present invention includes a rail assembly having a pair of elongate, spaced-apart substantially parallel rails. A slot is defined between the rails and extends substantially the entire length of the rail assembly. The slot presents a pair of opposed openings which likewise extend along the length of the rail assembly. A rod extends through the slot and the openings. The rail assembly includes a clip which is mounted thereon and which spans one of the openings. The clip is slidable along the length of the slot and includes means for maintaining the rod substantially normal to the rail assembly and means for fixing the rod against axial movement.

It is a general object of the present invention to provide a hanger assembly method and apparatus which overcomes the above-enumerated disadvantages associated with prior art hanger assemblies.

It is another object of the present invention to provide such a method and apparatus which can be more quickly installed than prior art hanger assemblies.

It is still another object of the present invention to provide such a method and apparatus which may be installed after installation of a ceiling.

It is yet another object of the present invention to provide such a method and apparatus which is capable of supporting heavier loads than prior art hanger assemblies.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENTS

Figure 1:
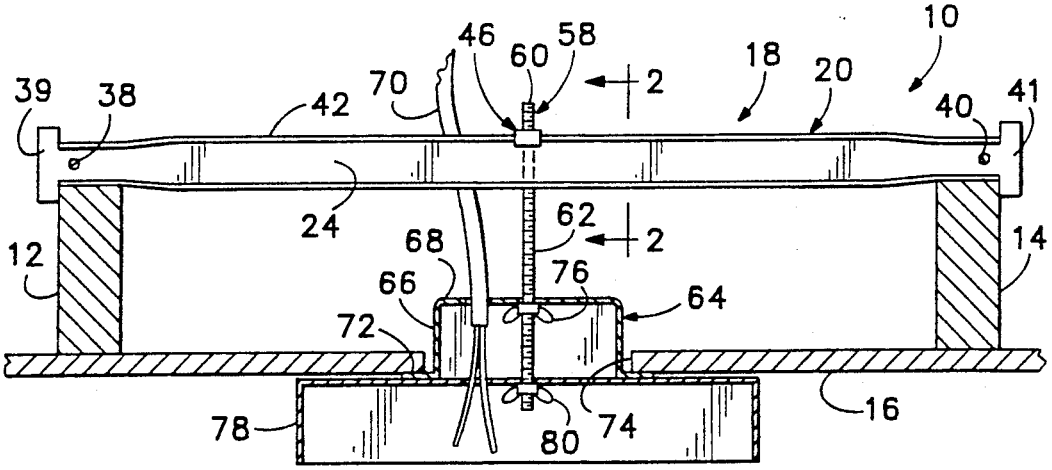
FIG. 1 is a partly sectional view of a hanger assembly constructed and installed in accordance with the present invention.

Indicated generally at 10 in FIG. 1 is a hanger assembly constructed in accordance with the present invention. The hanger assembly is suspended over the top of 2×4 boards 12, 14 which form a portion of a conventional truss, the remainder of which is not shown. A piece of sheetrock 16 is secured to the lower surfaces of boards 12, 14 (and to other portions of the truss) and forms a part of a ceiling which is supported by the truss. Boards 12, 14 might also comprise a pair of adjacent joists in a conventional ceiling.

Hanger assembly 10 includes a rail assembly 18 which is formed from a pair of rails 20, 22 and which extends between boards 12, 14. As can best be seen in FIG. 2, rail 20 includes a base 24 which extends between a pair of flanges 26, 28 formed substantially normal to base 24. Rail 22 is substantially identical to rail 20 and also includes a base 30 and flanges 32, 34. Each of the rails has a U-shaped cross section with bases 24, 30 forming the lower portion of the U. In the present embodiment of the invention, each of the rails is formed from a planar piece of sheet metal by cutting and bending the same.

A slot 36 is defined between the opposing surfaces of bases 24, 30. Rails 20, 22 are maintained in the illustrated positions relative to one another by spot welds 38, 40 which secure each end of the rails to one another. Bases 24, 30 are each bent inwardly toward one another at each end of the rail assembly so that the opposing surfaces of the bases are flush against one another at spot welds 38, 40. Slot 22, however, extends along substantially the entire length of rail assembly 18 between the facing surfaces of bores 12, 14. For a view of the rail assembly near spot weld 40, see FIG. 7, which is a partial view of a slightly different embodiment from FIGS. 1 and 2. Rail assembly 18 is substantially identical in both embodiments.

Figure 5:
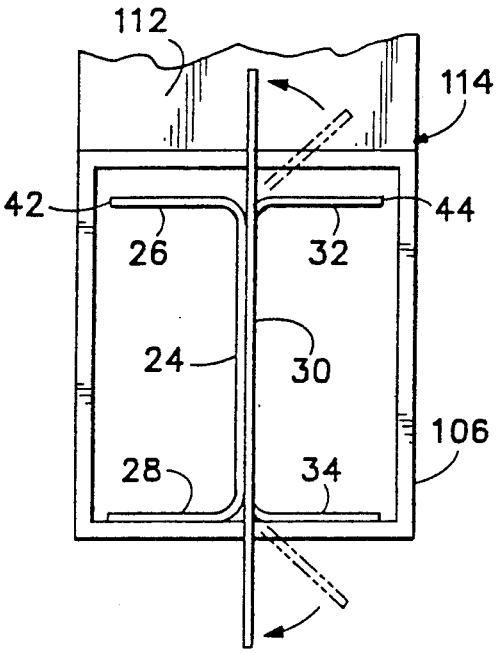
FIG. 5 is a view taken along 5—5 in FIG. 4.

Tabs 39, 41 are formed at opposite ends of rail assembly 18 by cutting each of flanges 26, 28, 32, 34 to its associated base and bending the flange as illustrated in FIG. 5.

Rails 20, 22 each include an upper edge 42, 44 respectively. A clip 46 extends over each of edges 42, 44 and includes portions 48, 50 which extend beneath flanges 26, 32 substantially parallel thereto. Clip 46 is thus slidable along substantially all of rail assembly 18 between the opposing faces of boards 12, 14.

The clip includes a pair of parallel slits 52, 54 which are centered over slot 36. Flexible portions 53, 55 are defined between slits 52, 54. A substantially square opening or hole 56 is cut in the clip also between slits 52, 54.

The clip supports a threaded rod 58 which is received through hole 56. Rod 58 includes a first portion 60 which extends above rail assembly 18 and a second portion 62 which extends therebelow. The openings at the upper and lower ends of slot 36 through which the rod extends are referred to herein as opposed openings.

Figure 2:
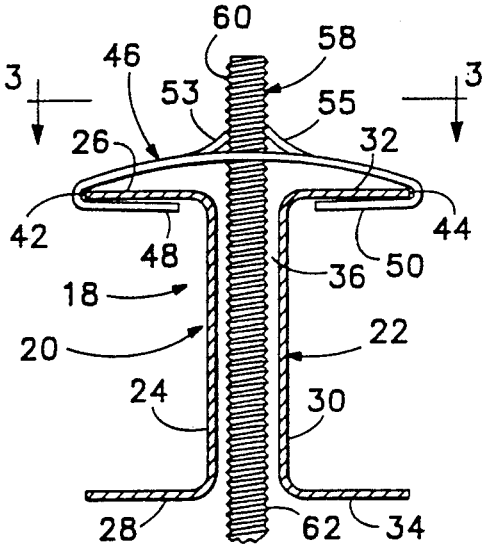
FIG. 2 is an enlarged sectional view taken along lines 2—2 in FIG. 1.

Rod 58 is sized relative to hole 56 so that the perimeter of the hole engages the threads and prevents downward movement thereof relative to clip 46 when rod 60 is inserted into hole 56 from the lower side thereof. At the same time, flexible portions 53, 55 are curved upwardly, as shown in FIG. 2, thus engaging the threads on the rod and preventing downward movement thereof relative to clip 46. When, however, rod 60 is pulled or pushed upwardly portions 53, 55 flex outwardly, as viewed in FIG. 2, and thus permit the rod to be selectively positioned relative to clip 46.

Turning again to FIG. 1, a junction cup 64 includes a substantially cylindrical side portion 66. The upper edge of side 66 is joined with a circular top portion 68. An electrical cable 70 extends into cup 64 via a hole, as shown, in top portion 68. An annular lip or flange 72 is joined to side 66 at the lower portion thereof and has an upper surface which abuts against the lower surface of sheetrock 16 about the circumference of a substantially circular hole 74 formed in the sheetrock.

Rod 60 extends through a bore formed in the center of circular portion 68 and a wing nut 76 urges flange 72 upwardly against the lower surface of ceiling 16 and urges rail assembly downwardly against the upper surface of boards 12, 14. It can be seen that such an arrangement provides a seal with ceiling 16 about the circumference of clip 64. This prevents the spread of smoke and flame in the event of fire.

A light fixture 78 includes a hole therethrough through which rod 58 is received. A second wing nut 80 is threadably received on rod 58 and urges fixture 78 upwardly against the lower surface of flange 72. It should be noted that rod 58 and not junction box 64 bears the weight of fixture 78.

Figure 4:
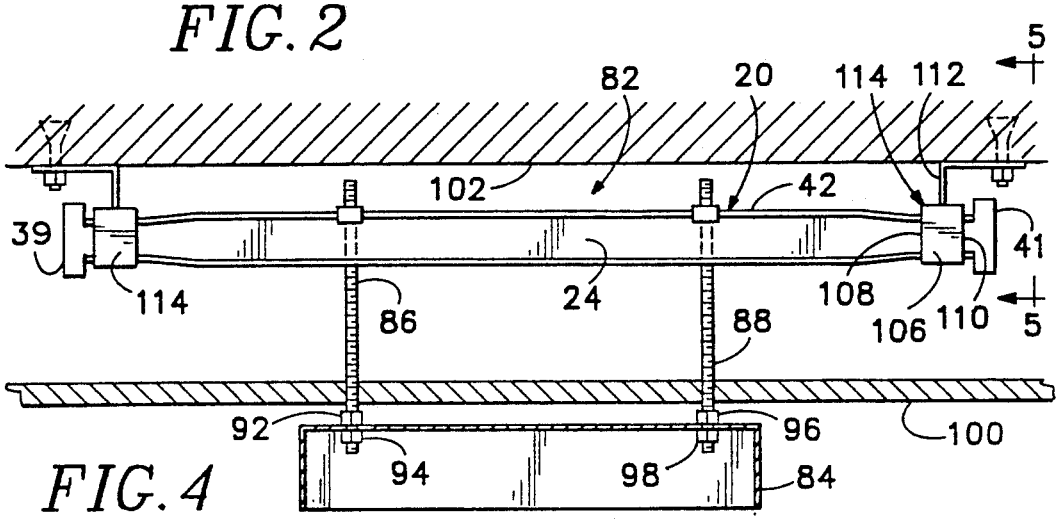
FIG. 4 is a view similar to FIG. 1 of a second embodiment of a hanger assembly constructed and installed in accordance with the present invention.

Turning now to FIGS. 4 and 5, indicated generally at 82 is a second embodiment of a hanger assembly constructed in accordance with the present invention.

Figure 3:
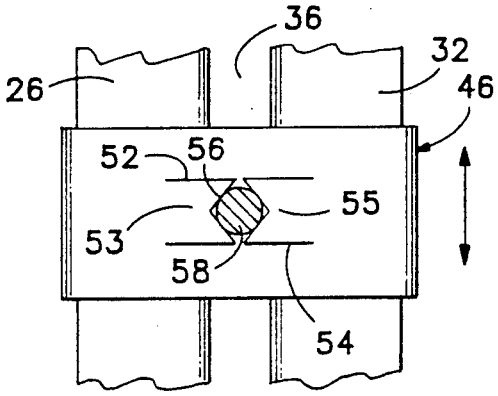
FIG. 3 is a partial view taken along lines 3—3 in FIG. 2.

Structure in hanger assembly 82 which is the same as structure identified in FIGS. 1–3 retains the same numeral in FIGS. 4 and 5. A fixture 84 is suspended from a pair of threaded rods 86, 88 by nuts 92, 94, 96, 98 which are threadably engaged on rods 86, 88 and which secure the fixture as shown. The rods extend through holes in a ceiling 100. The upper end of each of rods 86, 88 and is secured to a clip on the hanger assembly in the same fashion that rod 58 is secured to clip 46 in hanger assembly 10.

Ceiling 100 is of the drop-ceiling type. It is suspended in a conventional manner from a concrete super-structure 102. A bracket 104 includes a portion 106 having opposing ends 108, 110 and a square cross-section as can best be seen in FIG. 5. Rail assembly 18 extends through portion 106. Bracket 104 is mounted on a piece of angle iron 112 which is in turn bolted to superstructure 102. A substantially identical bracket 114 supports the other end of rail assembly 18.

Figure 6:
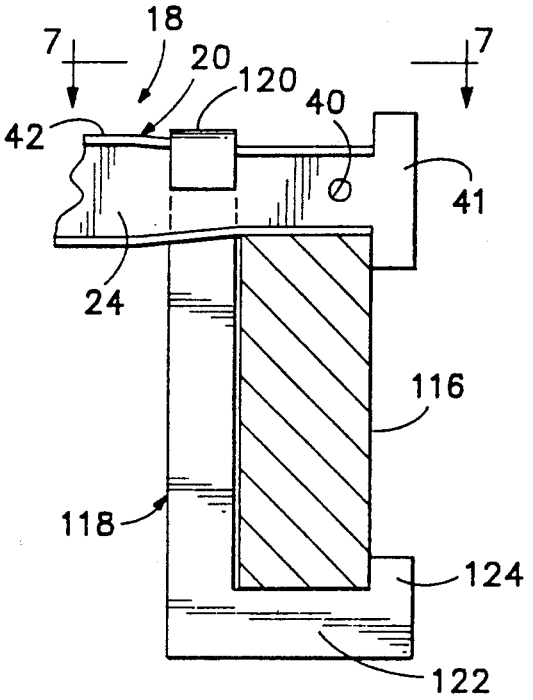
FIG. 6 is an enlarged view of the right end of a hanger assembly similar to that of FIG. 1 and further including a J-hook.
Figure 7:
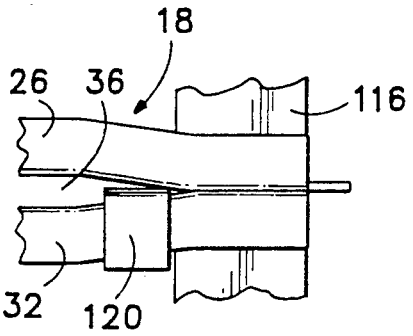
FIG. 7 is a view along 7—7 in FIG. 6.

Turning now to FIGS. 6 and 7, included therein is an additional embodiment of a hanger assembly constructed in accordance with the present invention. Numerals previously used to identify structure are used on corresponding structure in FIGS. 6 and 7. In FIG. 6, a board 116 makes up a portion of a truss (the rest of which is not shown). Board 116 is above the level of a ceiling (not shown) which is supported by other structure on the truss. As in FIG. 4, it may be necessary or desirable to suspend the hanger assembly further above the level of the ceiling than shown in the configuration of FIG. 1. When a wooden truss is present, as in FIG. 6, as opposed to a concrete superstructure, as in FIG. 4, the FIG. 6 embodiment is utilized.

Included in the embodiment of FIG. 6 is a J-hook 118. The hook is cut or stamped from a substantially planar piece of sheet metal and has an upper end 120 extending above slot 36 and bent over one of the rails as shown in FIGS. 6 and 7. A lower end 122 is fitted over the under side of board 116 and includes a portion 124 which extends to the side of board 116. A similar J-hook (not shown) is installed at the opposite end of the rail assembly of FIG. 6 on a board (also not shown) opposite board 116. Tabs 39, 41 thus fix the rail assembly against movement along the axis of the rail assembly while the J-hooks, like J-hook 118, prevent movement in a direction parallel to the axis of the truss boards, like board 116.

Considering now the installation and operation of hanger assembly 10 in FIGS. 1–3, the hanger assembly may be installed after installation of ceiling 16 as shown in FIG. 1. In the case of new construction, the location of the electrical cables, like cable 70, can be marked on a plan prior to installation of sheetrock. Thereafter, the sheetrock can be installed in the usual fashion without cutting holes, like hole 74, during installation. The plan can then be used to locate each of the cables and to cut a hole, like hole 74, in an appropriate location.

After cutting hole 74, rail assembly 18, including clip 46 but without rod 58 received therethrough, is inserted through the hole and placed over boards 12, 14 as shown in FIG. 1. Next, the installer puts one hand through hole 74 and grips rail assembly 18 and with the other hand inserts the upper end of rod 58 through slot 36 and through hole 56 in the clip. The rod is pushed upwardly through hole 56 until it is in approximately the position shown in FIG. 1. Cup 64 is then installed over the lower end of the rod with flange 72 positioned as shown. Tightening of nut 76 draws the cup upwardly against ceiling 16. When the cup is first installed, a knock-out is pushed out of circular top portion 68 and cable 70 is pulled therethrough as shown in FIG. 1. The cable is then pulled into the fixture which is in turn mounted on rod 58 using nut 80.

Because rail assembly 18 is received over boards 12, 14, the fixture is very securely mounted and is more able to withstand stresses, such as those imparted by earthquakes. In addition, hanger assembly 10 is able to hold heavier fixtures, such as fans, than are conventional hanger assemblies. Clip 46 facilitates lateral location of rod 58 at any point between the facing surfaces of boards 12, 14 thus providing maximum flexibility as to the placement of junction cup 64.

The embodiment of FIGS. 4 and 5 may be installed prior to installation of drop-ceiling 100 or after because panels in the drop ceiling can be removed to facilitate access to superstructure 102. It should be noted that tabs 39, 41 are not bent into the configuration shown in FIG. 4 prior to installation of the hanger assembly. Rather, the tabs remain in alignment with the central portion of the flanges, like flanges 26, 28, 32, 34. Opposing ends of rail assembly 18 may thus be inserted into brackets 104 and the ends thereafter bent to form tabs 39, 41, as illustrated in FIG. 5, thus fixing the rail assembly against axial movement. Rods 86, 88 and fixture 84 are then installed as described in connection with the embodiment of FIG. 1.

The assembly of claims 1 or 4 can also be installed by drilling holes in a pair of opposing joists or truss beams and slipping the ends of the hanger assembly in to the opposing holes in the same fashion that the ends are slipped into brackets 104, 114 in FIG. 4. It may be necessary or desirable to use a drill having a right-angle bit drive to create such holes in the case where access to the joists or beams is through a hole in a pre-existing ceiling.

The assembly of FIG. 1 can also be used to mount a ceiling fan by utilizing two rods and clips, as in FIG. 4, which extend through a junction cup, like junction cup 64, in FIG. 1. As with the fixture of FIG. 1, the ceiling fan is supported by the rods rather than by the cup. Wiring for the fan is brought through the cup in that same fashion that cable 42 is brought into cup 64 in FIG. 1. The two rods which support the fan resist the moment which a rotating fan applies to the structure from which the fan is suspended.

Figure 8:
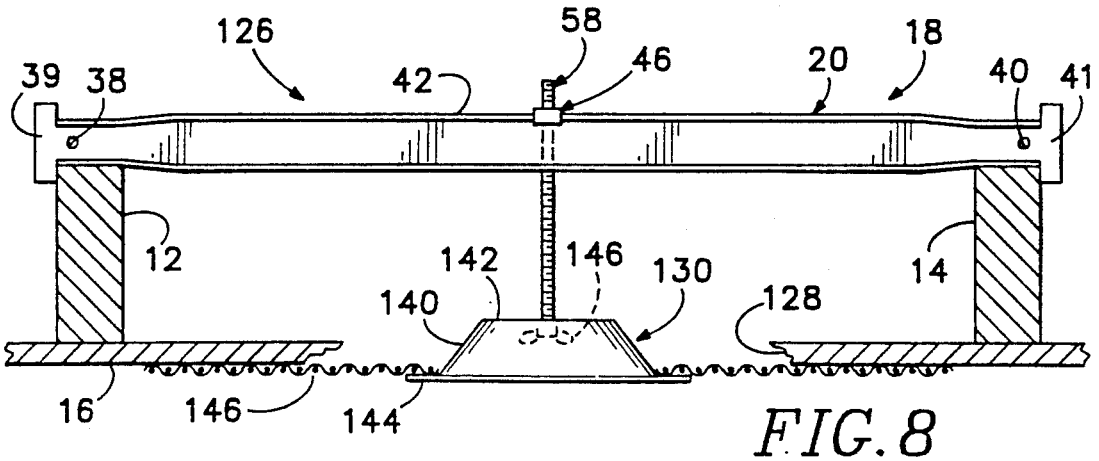
FIG. 8 is a view similar to FIGS. 1 and 4 of a third embodiment of the present invention used to patch a ceiling.

Turning now to FIG. 8, indicated generally at 126 is a modified embodiment of the present invention which provides a patch for a ceiling. Previously used numerals are used to identify corresponding structure in FIG. 8. Ceiling 16 includes an irregular hole 128. A cup 130 includes a frusto-conical wall 140 and a circular top 142. An annular flange 144 is formed about the circumference of the lower edge of wall 140. The cup is received through a hole in a screen 146 with the peripheral portions of the screen being urged against the lower surface of ceiling 16. The upper surface of flange 144 is urged against the lower surface of the screen and holds the same in place. A wing nut 146 secures the cup on rod 58.

Cup 130 is installed as shown similarly to the manner in which cup 64 is FIG. 1 is installed except that cup 130 is received through a substantially circular hole in screen 146 rather than through such a hole in ceiling 16. After the screen is positioned as shown in FIG. 8, conventional plaster or patching compound is applied to the screen and to the lower side of cup 130 thereby patching the hole in the ceiling.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A method for hanging a fixture comprising the steps of:

cutting a hole in a ceiling suspended from a set of truss beams or the like;

placing a rail assembly having a pair of elongate, spaced-apart, substantially parallel rails on an upwardly directed surface of a pair of truss beams or the like with the rail assembly over the ceiling hole, so that each of said rails substantially span the space between said truss beams;

placing a threaded rod between the rails so that it extends downwardly through the ceiling hole;

substantially fixing the rod against downward movement;

inserting the lower end of the rod through a hole in a junction cup having a downwardly directed opening with a surrounding lip;

threading a nut onto the lower end of said rod;

tightening said nut against said junction cup until said lip is flush against the ceiling and said rod is in tension thereby fixing said rail assembly, said rod and said cup against movement; and mounting a fixture on said junction cup.

2. The method of claim 1 wherein said rod is threaded and wherein the step of substantially fixing the rod against downward movement comprises the steps of:

sliding a clip having hole therethrough onto one end of said rail assembly; and threadedly engaging said rod with said hole.

3. The method of claim 2 wherein said method further includes the step of adjusting the position of the rod by sliding said clip along the rail assembly.

4. The method of claim 1 wherein the step of mounting a fixture on the lower end of said junction cup comprises the steps:

of moving said fixture so that the rod is received through a hole in the fixture;

threading a second nut onto said rod; and tightening said nut until said fixture abuts said junction cup.

5. The method of claim 4 wherein the step of disposing a rail assembly having a pair of elongate, spaced-apart, substantially parallel rails between a pair of truss beams or the like comprises the step of placing the rail assembly on the top surface of the truss beams or the like.

6. The method of claim 5 wherein said method further includes the step of fixing the rail assembly against axial movement.

7. The method of claim 6 wherein the step of fixing the rail assembly against axial movement comprises the step of bending down the ends of said rail assembly beneath the top surface of the truss beams or the like.

8. The method of claim 1 wherein said method further includes the step of varying the length of rod which extends downwardly from said rails.

9. The method of claim 1 wherein said method further includes the steps of:

drilling opposing holes in said truss beams; and inserting the ends of said rail assembly in said holes.

10. A hanger assembly comprising:

an elongate rail assembly having a fixed predetermined length and further having a pair of elongate, spaced-apart, substantially parallel rails, said rails being longitudinally fixed relative to one another;

means for disposing said rail assembly between a pair of truss beams or the like having a ceiling suspended on the lower portion thereof;

a slot defined between said rails and extending substantially the entire length of said rail assembly, said slot presenting a pair of opposed openings which extend along the length thereof;

a threaded rod extending through said slot and said openings, said rod being slidable along the length of said slot;

a clip axially slidable on said rail assembly;

means for engaging said clip with said rod whereby a first portion of rod extends below said ceiling and a second portion of rod extends above said rail assembly;

means for adjusting the length of said first portion; and means for mounting both a junction box and a fixture on the lower end of said rod, said junction box being mounted substantially above said ceiling and said fixture being mounted substantially below said ceiling.

11. The hanger assembly of claim 10 wherein said hanger assembly further comprises means for fixing said rod against axial movement.

12. The hanger assembly of claim 11 wherein said means for fixing said rod against axial movement comprises means for substantially fixing said rod against downward axial movement and means for substantially permitting upward axial movement.

13. The hanger assembly of claim 12 wherein said means for substantially fixing said rod against axial movement in one direction and means for substantially permitting axial movement in the other direction comprise a hole in said clip through which said rod is received, said hole including means for engaging said rod threads when axial force is exerted along said rod in one direction.

14. The apparatus of claim 10 wherein said clip extends over and around an upper edge on each of said rails thereby preventing said rails from spreading apart from one another.

15. The hanger assembly of claim 10 wherein said junction box comprises a junction cup having an opening directed away from said rail assembly and wherein said hanger assembly further includes:

a lip surrounding said cup opening; and means for urging said cup toward said rail assembly with said rail assembly being so disposed, said cup being received in a hole formed in said ceiling with said cup opening directed downwardly and said cup lip extending over the edge of said hole.

16. The hanger assembly of claim 15 wherein said means for urging said cup toward said rail assembly comprises a nut threaded on the first portion of said rod.

17. The hanger assembly of claim 10 wherein said means for disposing said rail assembly between a pair of truss beams or the like comprises:

means for supporting said rail assembly across the top surface of a pair of truss beams or the like; and means for fixing said rail assembly to such truss beams.

18. The hanger assembly of claim 10 wherein said hanger assembly further comprises:

a second threaded rod;

a second clip axially slidable on said rail assembly;

means for engaging said second clip with said second rod whereby a first portion of said second rod extends below said rail assembly toward said ceiling and a second portion of said second rod extends above said rail assembly;

means for adjusting the length of said first portion of said second rod; and means for suspending a ceiling fan from said rods.

19. The method of claim 1 wherein the step of placing a rail assembly having a pair of elongate, spaced-apart, substantially parallel rails on an upwardly directed surface of a pair of truss beams or the like comprises the steps of inserting the rail assembly through the ceiling hole from beneath the ceiling and thereafter placing the rail assembly on an upwardly directed surface of a pair of truss beams or the like.

20. The method of claim 19 wherein the step of placing a threaded rod between the rails so that it extends downwardly through the ceiling hole comprises the step of inserting the rod through the ceiling hole in and thereafter placing the rod between the rails.

21. The hanger assembly of claim 10 wherein said hanger assembly further includes a hole in said clip through which said rod is received, said hole including means for engaging said rod threads when a downward axial force is exerted on said rod and means for permitting rod movement when an upward axial force is extended on said rod.

22. The hanger assembly of claim 10 wherein said clip extends about said rails and prevents the same from spreading apart responsive to application of a downward force on the first portion of said rod.

* * * * *